US010604364B2

(12) United States Patent
Takefushi et al.

(10) Patent No.: US 10,604,364 B2
(45) Date of Patent: Mar. 31, 2020

(54) MEDIUM PROCESSING DEVICE AND MEDIUM TRANSACTION DEVICE

(71) Applicant: Oki Electric Industry Co., Ltd., Tokyo (JP)

(72) Inventors: Yoshitoshi Takefushi, Tokyo (JP); Madoka Wakabayashi, Tokyo (JP); Satoru Iwasaki, Tokyo (JP); Kentaro Kamagata, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/302,479

(22) PCT Filed: Apr. 13, 2017

(86) PCT No.: PCT/JP2017/015182
§ 371 (c)(1),
(2) Date: Nov. 16, 2018

(87) PCT Pub. No.: WO2017/221530
PCT Pub. Date: Dec. 28, 2017

(65) Prior Publication Data

US 2019/0295352 A1 Sep. 26, 2019

(30) Foreign Application Priority Data

Jun. 24, 2016 (JP) ..... 2016-125990

(51) Int. Cl.
*B65H 5/06* (2006.01)
*B65H 31/22* (2006.01)
(Continued)

(52) U.S. Cl.
CPC ..... *B65H 5/06* (2013.01); *B65H 31/22* (2013.01); *G07D 11/125* (2019.01); *G07D 11/14* (2019.01);
(Continued)

(58) Field of Classification Search
CPC ..... B65H 29/001; B65H 31/22; B65H 2403/941; B65H 2407/11; B65H 2407/20;
(Continued)

(56) References Cited

U.S. PATENT DOCUMENTS 6,139,011 A * 10/2000 Huang ..... B65H 5/062 271/114
8,047,540 B2 * 11/2011 Daigo ..... B65H 1/266 271/264
(Continued)

FOREIGN PATENT DOCUMENTS

JP 2013-174946 A 9/2013
JP 2016-57967 A 4/2016
WO WO-2014/192128 A1 12/2014

*Primary Examiner* — Patrick Cicchino
(74) *Attorney, Agent, or Firm* — Rabin & Berdo, P.C.

(57) ABSTRACT

A medium processing device is provided including: a conveyance section that conveys a sheet-shaped medium along a conveyance path; a drive transmission section that transmits drive force to the medium so as to cause the medium to travel along the conveyance path; an operation knob that is provided on an operation side face of the conveyance section, and that is used for operating the drive transmission section; and a storage box that stores the medium therein, and that is capable of transitioning between an opposing state in which the storage box opposes the operation side face of the conveyance section over a range including at least the operation knob, and a non-opposing state in which the storage box does not oppose the operation side face.

8 Claims, 10 Drawing Sheets

(51) Int. Cl.

| | |
|---|---|
| ***G07D 11/14*** | (2019.01) |
| ***G07D 11/26*** | (2019.01) |
| ***G07D 11/125*** | (2019.01) |
| ***G07F 19/00*** | (2006.01) |
| ***G07D 11/16*** | (2019.01) |

(52) U.S. Cl.
CPC ..... *G07D 11/26* (2019.01); *B65H 2403/941* (2013.01); *B65H 2407/20* (2013.01); *B65H 2601/325* (2013.01); *B65H 2601/326* (2013.01); *G07D 11/16* (2019.01); *G07D 2211/00* (2013.01); *G07F 19/205* (2013.01)

(58) Field of Classification Search
CPC ..... B65H 2601/325; B65H 2601/326; B65H 5/062; B65H 5/06; B65H 5/00
See application file for complete search history.

(56) References Cited

U.S. PATENT DOCUMENTS

| | | | | |
|---|---|---|---|---|
| 8,636,283 | B2 * | 1/2014 | Akiyama | B65H 5/062 271/264 |
| 8,657,278 | B2 * | 2/2014 | Ozeki | G03G 15/6502 271/10.04 |
| 8,967,612 | B2 * | 3/2015 | Yokote | B65H 5/00 271/3.01 |
| 9,522,796 | B2 * | 12/2016 | Lee | B65H 5/06 |
| 9,592,975 | B2 * | 3/2017 | Ishikawa | B65H 3/44 |
| 9,718,632 | B2 * | 8/2017 | Saeki | B65H 3/0669 |
| 9,731,926 | B2 * | 8/2017 | Kadota | G07D 11/00 |
| 10,442,221 | B2 * | 10/2019 | Aihara | B65H 5/26 |
| 2017/0309133 | A1 | 10/2017 | Okamoto et al. | |
| 2019/0004469 | A1 * | 1/2019 | Dobashi | B26B 5/00 |

* cited by examiner

MEDIUM PROCESSING DEVICE AND MEDIUM TRANSACTION DEVICE

TECHNICAL FIELD

This application claims priority from Japanese Patent Application No. 2016-125990, filed on Jun. 24, 2016, the disclosure of which is incorporated in its entirety by reference herein.

The present disclosure relates to a medium processing device and a medium transaction device, and may, for example, be applied to an Automated Teller Machine (ATM) that performs desired transactions when a customer inserts a medium such as a banknote.

BACKGROUND ART

ATMs widely employed in financial institutions and the like allow a customer to pay in cash in the form of banknotes or coins, or pay out cash to a customer, according to the content of a transaction with the customer.

Proposals have been made for an ATM including, for example, a controller that controls the overall ATM, a banknote pay-in/pay-out section that exchanges banknotes with a customer, a conveyance section that conveys inserted banknotes along a conveyance path, a classification section that classifies banknotes according to denomination and authenticity, a temporary retention section that temporarily retains inserted banknotes, and banknote storage boxes that store banknotes by denomination.

In such an ATM, after a customer inserts banknotes into a banknote pay-in/pay-out port in a pay-in transaction, the inserted banknotes are classified by the classification section, and banknotes classified as normal banknotes are stored in the temporary retention section, whereas banknotes classified as being unsuitable for transactions are returned to the banknote pay-in/pay-out port and given back to the customer. Then, after the customer has confirmed a pay-in amount, the ATM feeds out the banknotes stored in the temporary retention section to be reclassified by the classification section according to denomination, and stores the banknotes in the respective banknote storage boxes according to their classified denominations.

Plural conveyance rollers disposed along the conveyance path in the conveyance section are rotated using drive force supplied from a predetermined drive motor, enabling the banknotes to be conveyed along the conveyance path (see, for example, Japanese Patent Application Laid-Open (JP-A) No. 2016-57967). The conveyance section may also be provided with an operation knob used to rotate the conveyance rollers and the like manually during maintenance operations.

For example, when a banknote jam has arisen in the conveyance section of an ATM, a maintenance technician removes the banknote pay-in/pay-out section and the temporary retention section from the conveyance section to expose a handover port with the temporary retention section or the like. The maintenance technician is then able to manually rotate the operation knob of the conveyance section of the ATM to manually propel banknotes remaining on the conveyance path along the conveyance path, and extract such banknotes from the handover port.

SUMMARY OF INVENTION

Technical Problem

In ATMs, in order to strictly manage the banknotes, the controller records and continually updates the denominations and number of banknotes stored in each section, such as the temporary retention section and the banknote storage boxes.

Accordingly, when a maintenance technician manually extracts banknotes or stores banknotes in each section during a maintenance operation on an ATM, a discrepancy arises between the number of banknotes as recorded by the controller and the actual number of banknotes stored in each section, rendering the controller incapable of correctly ascertaining the number of banknotes stored in each section. In such cases, for example, the ATM maintenance technician performs a recorded content rectification operation using a predetermined operation section, thus restoring the ability to accurately ascertain the number of banknotes stored in each section.

However, in the conveyance section of such an ATM, the conveyance path is almost completely surrounded by conveyance guides and the like that guide banknotes, making banknotes in the conveyance path difficult for the maintenance technician to see from the outside. Accordingly, the maintenance technician might unwittingly manually convey a banknote so as to be stored in one of the various sections of the ATM, including the banknote storage boxes, if the banknote storage boxes are not removed in a maintenance operation.

In such cases, a discrepancy would arise in the ATM between the number of banknotes in each section as ascertained by the controller, and the actual number of banknotes. There is a concern that the maintenance technician might unwittingly fail to rectify the number of banknotes, namely, that the ATM may resume operation in a state in which the controller has not accurately ascertained the number of banknotes in each section.

In consideration of the above circumstances, the present disclosure proposes a medium processing device and a medium transaction device capable of preventing a medium from being conveyed to an unintended location during a maintenance operation.

Solution to Problem

A medium processing device of a first aspect of the present disclosure includes: a conveyance section that conveys a sheet-shaped medium along a conveyance path; a drive transmission section that is provided within the conveyance section, and that transmits drive force from a predetermined drive source to the medium so as to cause the medium to travel along the conveyance path; an operation knob that is provided on an operation side face configuring one side face of the conveyance section, and that is used for manually operating the drive transmission section; and a storage box that stores the medium therein, and that is capable of transitioning between an opposing state in which the storage box is coupled to the conveyance path and opposes the operation side face of the conveyance section over a range including at least the operation knob, and a non-opposing state in which the storage box is separated from the conveyance path and does not oppose the operation side face.

A medium transaction device of another aspect of the present disclosure is provided with: a conveyance section that conveys a sheet-shaped medium for transaction with a user along a conveyance path; a drive transmission section that is provided within the conveyance section, and that transmits drive force from a predetermined drive source to the medium so as to cause the medium to travel along the conveyance path; an operation knob that is provided on an operation side face configuring one side face of the conveyance section, and that is used for manually operating the drive transmission section; and a storage box that stores the medium therein, and that is capable of transitioning between an opposing state in which the storage box is coupled to the conveyance path and opposes the operation side face of the conveyance section over a range including at least the operation knob, and a non-opposing state in which the storage box is separated from the conveyance path and does not oppose the operation side face.

In the present aspect, operation of the operation knob by a maintenance technician is restricted when the storage box is in the opposing state, enabling the medium to be prevented from being conveyed manually along the conveyance path toward the storage box. In the present aspects, the storage box is separated from the conveyance path when the storage box is in the non-opposing state, such that the operation knob is exposed, permitting operation by the maintenance technician and enabling the medium to be conveyed manually along the conveyance path. Thus, the present disclosure is able to prevent the maintenance technician from unwittingly conveying the medium to the storage box to be stored therein.

Effects of Invention

The present disclosure realizes a medium processing device and a medium transaction device capable of preventing a medium from being conveyed to an unintended location during a maintenance operation.

DESCRIPTION OF EMBODIMENTS

Explanation follows regarding embodiments (referred to hereinafter as exemplary embodiments) for implementing the present disclosure, with reference to the drawings.

1. First Exemplary Embodiment

1-1. ATM and Banknote Pay-in/Pay-Out Device Configuration

Figure 1:
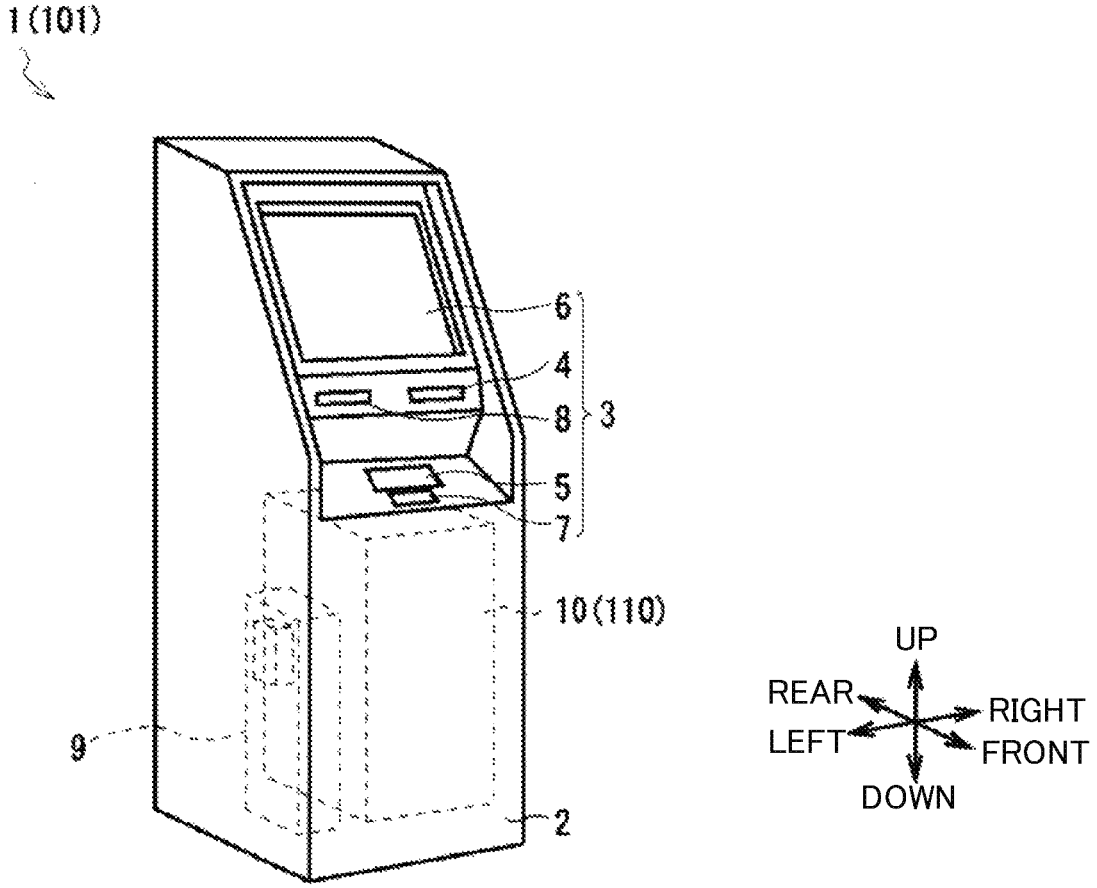
FIG. 1 is a schematic perspective view illustrating an external configuration of an ATM.

As in the external view illustrated in FIG. 1, an ATM 1 serving as a medium transaction device is mainly configured by a box-shaped casing 2, and is installed in a financial institution or the like. The ATM 1 performs cash transactions, including pay-in processing and pay-out processing, with a user (namely, a customer of the financial institution).

The casing 2 includes a customer interface 3 at a location enabling banknote insertion, touch panel operation, and the like by a customer facing the casing 2 from the front side. The customer interface 3 performs cash or card interactions and so on directly with the customer, provides transaction-related information, and accepts operation instructions. The customer interface 3 is provided with a card insertion/removal port 4, a pay-in/pay-out port 5, an operation and display section 6, a ten-key 7, and a receipt issue port 8.

The card insertion/removal port 4 is a section through which various cards such as a cash card are inserted and dispensed. A card processor (not illustrated in the drawings) that reads an account number and the like magnetically recorded on the various cards is provided behind the card insertion/removal port 4. A customer inserts banknotes to be paid in into the pay-in/pay-out port 5, and the pay-in/pay-out port 5 dispenses banknotes to be paid out to the customer. The pay-in/pay-out port 5 is opened and closed by driving a shutter. Banknotes are, for example, formed in sheets by rectangular shaped papers.

The operation and display section 6 is a touch panel in which a liquid crystal display (LCD) that displays operation screens during a transaction is integrated together with a touch sensor that is input with transaction type selections, PINs, transaction amounts, and the like. The ten-key 7 is a physical keypad that receives input of the numbers 0 to 9, for example, and is employed during PIN or transaction amount input operations. The receipt issue port 8 is a section that issues receipts printed with transaction details and the like on completion of transaction processing. A receipt processor (not illustrated in the drawings) that prints transaction details and the like on the receipts is provided behind the receipt issue port 8.

In the following explanation, the front side of the ATM 1 is defined as the side faced by a customer, and the rear side of the ATM 1 is defined as the opposite side thereto. The left side and right side of the ATM 1 are respectively defined as the left and right from the perspective of a customer facing the front side, and the upper side and lower side of the ATM 1 are also defined from this perspective.

A main controller 9 that controls the overall ATM 1, and a banknote pay-in/pay-out device 10 that performs various processing relating to banknotes, are provided inside the casing 2. The main controller 9 is configured by a processor such as a non-illustrated Central Processing Unit (CPU), and reads and executes predetermined programs from non-illustrated Read Only Memory (ROM), flash memory, or the like so as to perform various processing such as pay-in processing and pay-out processing. The main controller 9 also includes an internal storage section configured by Random Access Memory (RAM), hard disk drive, flash memory, or the like. Various information is stored in the storage section.

Figure 2:
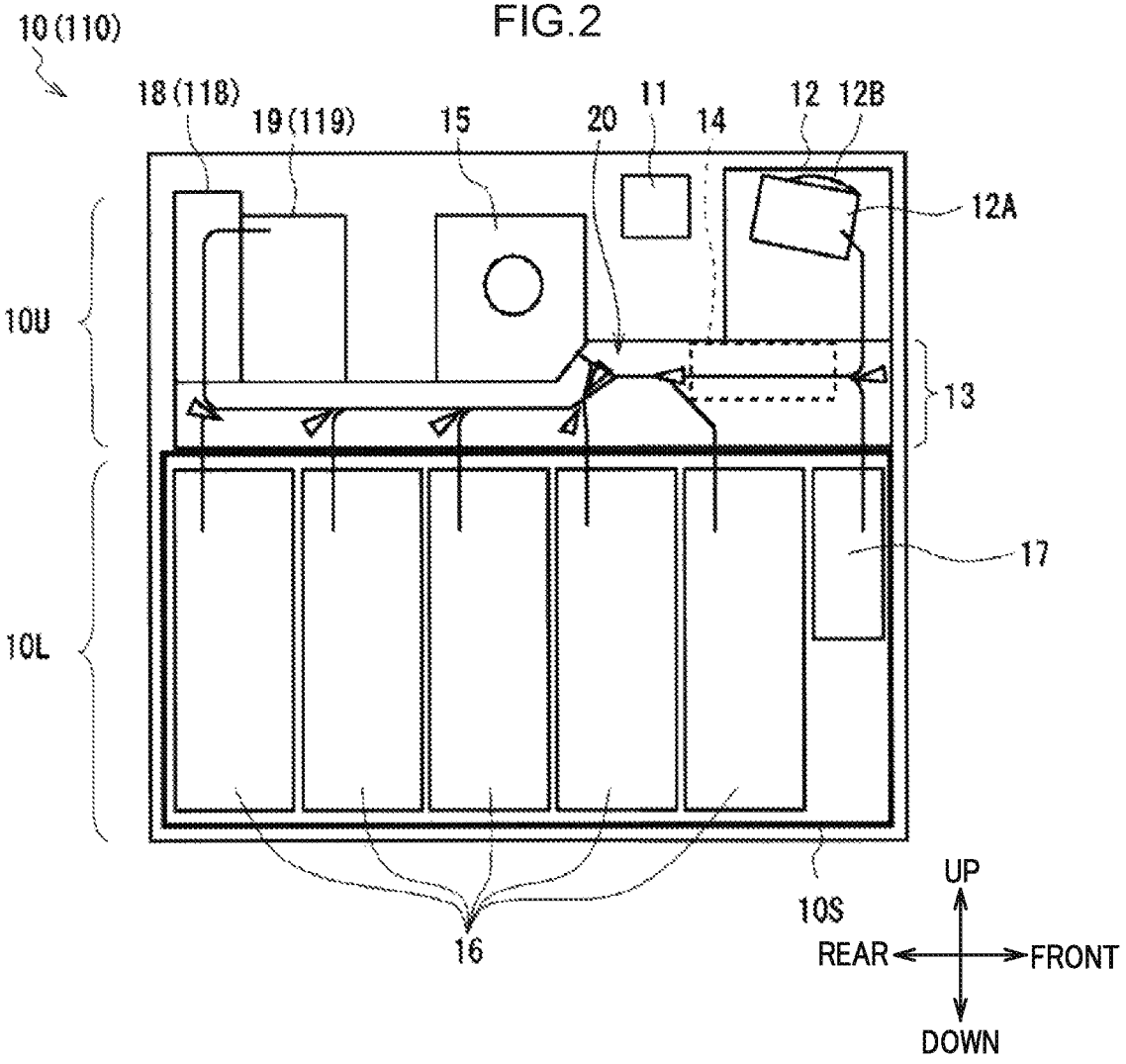
FIG. 2 is a schematic view illustrating configuration of a banknote pay-in/pay-out device.

As illustrated in side view in FIG. 2, plural sections that perform various processing relating to banknotes, serving as a medium, are incorporated inside the banknote pay-in/pay-out device 10. The banknote pay-in/pay-out device 10 is broadly configured by an upper unit 10U configuring a portion to the upper side of the approximate vertical direction center of the banknote pay-in/pay-out device 10, and a lower unit 10L configuring a portion to the lower side of the approximate vertical direction center of the banknote pay-in/pay-out device 10.

The banknote pay-in/pay-out device 10 is attached to the casing 2 through slide rails (not illustrated in the drawings). During a maintenance operation, the banknote pay-in/pay-out device 10 is pulled out rearward in a state in which a rear side face of the casing 2 has been opened, thereby exposing the various sections.

The upper unit 10U includes a banknote controller 11 that performs overall control, a pay-in/pay-out section 12 that exchanges banknotes with a customer, a conveyance section 13 and an upper conveyance section 18 that respectively convey banknotes between the various sections, a classification section 14 that classifies banknotes, a temporary retention section 15 that temporarily stores banknotes, and an upper storage box 19 that stores banknotes.

Similarly to the main controller 9, the banknote controller 11 is configured by a non-illustrated CPU. The banknote controller 11 reads and executes predetermined programs from non-illustrated ROM, flash memory, or the like to perform various processing such as processing to set banknote conveyance destinations and processing to control actuation of the various sections. The banknote controller 11 includes an internal storage section configured by RAM, flash memory, and the like, and stores various information in the storage section. For example, the banknote controller 11 stores (records) the denomination and number of banknotes stored in each section of the banknote pay-in/pay-out device 10 in the storage section, and continually updates this information.

The pay-in/pay-out section 12 is positioned at a front upper portion inside the upper unit 10U. The pay-in/pay-out section 12 includes an internal receptacle 12A that holds banknotes received from a user and banknotes to be passed to a user. The pay-in/pay-out section 12 is able to be opened and closed from above by a shutter 12B. Plural banknotes are held inside the receptacle 12A in a stacked state in which the faces of the banknotes face along the front-rear direction. The pay-in/pay-out section 12 separates and passes banknotes inside the receptacle 12A to the conveyance section 13 one note at a time, and banknotes received from the conveyance section 13 are discharged to and stacked in the receptacle 12A.

The conveyance section 13 is positioned at a lower end portion inside the upper unit 10U. The conveyance section 13 has a general profile that is thin in the vertical direction and long and narrow in the front-rear direction. A conveyance guide that guides banknotes, and multiple rotating rollers and the like are disposed inside the conveyance section 13, forming a linear conveyance path along which banknotes are conveyed principally along the front-rear direction, with the short edges of the banknotes aligned with the direction of travel.

Figure 3:
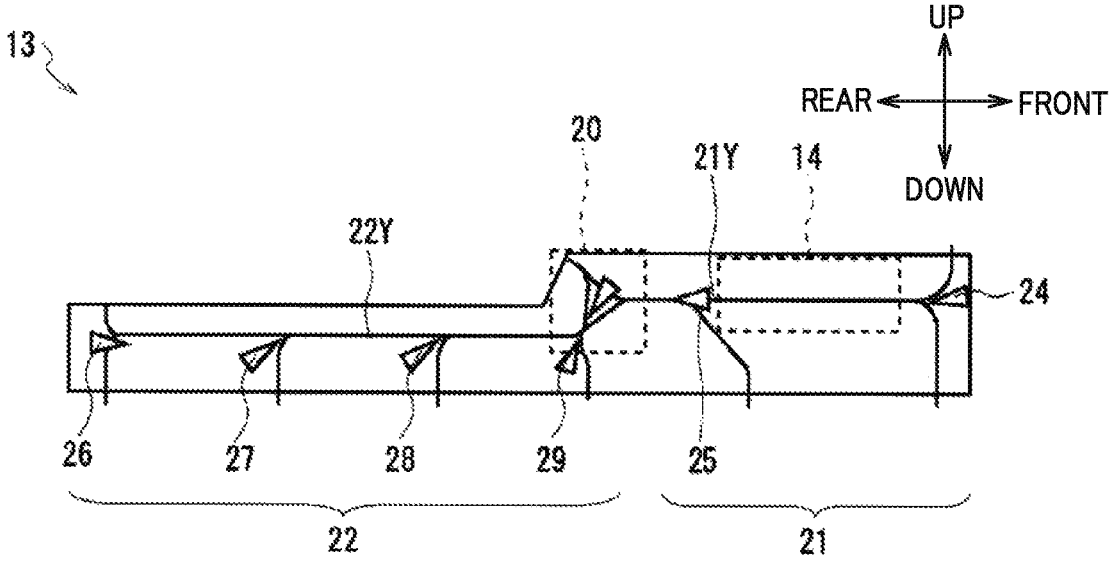
FIG. 3 is a schematic view illustrating configuration of a conveyance section.

As illustrated in an enlarged view in FIG. 3, the conveyance section 13 is broadly configured by a temporary retention switch 20 disposed in the vicinity of the center, and a front conveyance section 21 and a rear conveyance section 22 respectively disposed at the front side and rear side of the temporary retention switch 20. The temporary retention switch 20 switches the banknote conveyance path under control of the banknote controller 11 such that banknotes are conveyed between the front conveyance section 21, the rear conveyance section 22, and the temporary retention section 15.

A reject switch 24, the classification section 14, and a switch 25 are disposed in series in sequence from front to rear inside the front conveyance section 21, and a substantially linear front conveyance path 21Y is formed along the front-rear direction. The reject switch 24 and the switch 25 switch the banknote conveyance path based on control of the banknote controller 11. Switches 26, 27, 28, and 29 are disposed substantially in series in sequence from rear to front inside the rear conveyance section 22, and a substantially linear rear conveyance path 22Y is formed running along the front-rear direction. The respective conveyance paths of the front conveyance section 21 and the rear conveyance section 22 are each capable of accommodating several banknotes.

The classification section 14 is incorporated inside the front conveyance section 21, and is positioned between the pay-in/pay-out section 12 and the temporary retention switch 20 on the banknote conveyance path. Plural types of sensor, including a thickness sensor, an image sensor, and a magnetic sensor, are incorporated inside the classification section 14, and the classification section 14 identifies conveyed banknotes by denomination, authenticity, physical condition (the presence or absence of damage), and transmits identification results to the banknote controller 11.

The temporary retention section 15 (FIG. 2) employs what is referred to as tape escrow method, in which banknotes are stored by being wrapped against a circumferential side face of a cylindrical drum together with a tape, and banknotes are fed out by being peeled away from the circumferential side face together with the tape.

The upper conveyance section 18 is disposed in the vicinity of a rear end at the upper side of the conveyance section 13, and conveys banknotes from a lower end toward an upper front side of the upper conveyance section 18. The upper storage box 19 is provided at a location toward the rear at the upper side of the conveyance section 13, at a position adjacent to the front side of the upper conveyance section 18. The upper storage box 19 receives and internally stores banknotes conveyed by the upper conveyance section 18. The upper storage box 19 is, for example, used as a counterfeit note storage box in which banknotes determined to be counterfeit notes (fake banknotes) by the classification section 14 are stored separately to other banknotes.

All the peripheral side faces of the lower unit 10L are covered by a strong safe casing 10S. Five banknote storage boxes 16 and a reject box 17 are provided inside the safe casing 10S in sequence from the rear side toward the front side.

Each banknote storage box 16 is formed in a rectangular block shape that is long in the vertical direction, and contains an internal space in which banknotes are stacked and stored. Each banknote storage box 16 stores banknotes of a preset denomination. Each banknote storage box 16 receives banknotes from the conveyance section 13, which are then stacked and stored internally. When the banknote storage box 16 receives an instruction from the banknote controller 11 to feed out banknotes, the stacked banknotes are separated and fed out one note at a time to be passed to the conveyance section 13.

The reject box 17 is formed in a rectangular block shape that is long in the vertical direction, and contains an internal space in which banknotes are stacked and stored. The reject box 17 internally stores banknotes (what are referred to as reject banknotes) conveyed by the conveyance section 13 after being determined to be heavily damaged and unsuitable for re-use by the classification section 14 and the banknote controller 11.

1-2. Pay-in Processing

Explanation follows regarding pay-in processing in the banknote pay-in/pay-out device 10 when the ATM 1 performs a pay-in transaction with a customer. In pay-in processing, controlled by the banknote controller 11, the banknote pay-in/pay-out device 10 first performs pay-in count processing in which the number of banknotes is counted while classifying the denomination and the like of paid in banknotes. Next, pay-in storage processing is performed to convey the banknotes to appropriate storage locations to be stored.

Specifically, for example, when the banknote controller 11 receives operation input to start a pay-in transaction from a customer via the operation and display section 6 (FIG. 1), the pay-in count processing is started, and the customer is prompted to insert banknotes to the receptacle 12A of the pay-in/pay-out section 12. These banknotes are separated and taken in one note at a time, and passed to the conveyance section 13 in sequence. The conveyance section 13 conveys the banknotes received from the pay-in/pay-out section 12 toward the rear in sequence using the front conveyance section 21. Each banknote is classified in sequence by the classification section 14, and then passed to the temporary retention switch 20 in sequence. When this is performed, the classification section 14 transmits the obtained classification results to the banknote controller 11.

Based on the acquired classification results, the banknote controller 11 determines the degree of damage, denomination, and authenticity of each banknote. Next, the banknote controller 11 determines any banknote that could be identified as a normal banknote to be a pay-in acceptable banknote which may continue on to subsequent processing, and determines any banknote that cannot be identified as a normal banknote to be a pay-in reject banknote that should provisionally be given back to the customer.

The banknote controller 11 also sets the final destination of the pay-in acceptable banknotes, this being the banknote storage box 16 for the corresponding denomination in the case of normal banknotes that are suitable for re-use, and the reject box 17 in the case of reject banknotes with a large degree of damage. The banknote controller 11 also sets the upper storage box 19 as the final destination in the case of counterfeit notes.

Next, according to the determination results for each banknote passed from the front conveyance section 21 to the temporary retention switch 20, the banknote controller 11 conveys the pay-in acceptable banknotes and counterfeit notes to the temporary retention section 15 to be stored, while pay-in reject banknotes are carried into the rear conveyance section 22 to be accommodated in the rear conveyance path 22Y.

After the banknote controller 11 has finished taking in all of the banknotes from the receptacle 12A of the pay-in/pay-out section 12, if any pay-in reject banknotes are being accommodated in the rear conveyance path 22Y of the rear conveyance section 22, these banknotes are given back to the customer. The banknote controller 11 thereby conveys these banknotes to the pay-in/pay-out section 12 via the front conveyance section 21 to be given back to the customer, who is prompted to check the banknotes and reinsert them if necessary. If there are no pay-in reject banknotes being accommodated in the rear conveyance path 22Y of the rear conveyance section 22, the banknote controller 11 completes the pay-in count processing.

When this is performed, the banknote controller 11 calculates a pay-in amount based on the denominations of the banknotes that have been taken in from the pay-in/pay-out section 12 and the count results for the number of banknotes, and a predetermined operation instruction screen is displayed on the operation and display section 6. The pay-in amount is presented to the customer, who is prompted to select whether or not to continue with the pay-in transaction. In cases in which the customer gives an instruction to cancel the pay-in transaction, the banknote controller 11 conveys all of the banknotes retained in the temporary retention section 15 to the pay-in/pay-out section 12 using the conveyance section 13 to be given back to the customer.

In cases in which the customer gives an instruction to continue with the pay-in transaction, the banknote controller 11 starts the pay-in storage processing. Specifically, first, the banknote controller 11 starts feed-out processing such that the temporary retention section 15 sequentially feeds out the banknotes (pay-in acceptable banknotes and counterfeit notes) stored therein, and passes the banknotes to the temporary retention switch 20.

When this is performed, the banknote controller 11 uses the temporary retention switch 20 and the other respective switches to switch the conveyance path of each banknote according to the conveyance destination of each banknote as set during the pay-in count processing, and conveys the banknotes to their respective conveyance destinations to be stored. The banknote controller 11 is thus capable of storing normal banknotes that may be re-used sorted by denomination in the respective banknote storage boxes 16, capable of storing pay-in reject banknotes that should not be re-used in the reject box 17, and also capable of storing counterfeit notes in the upper storage box 19.

1-3. Upper Conveyance Section and Upper Storage Box Configuration

Figure 4A:
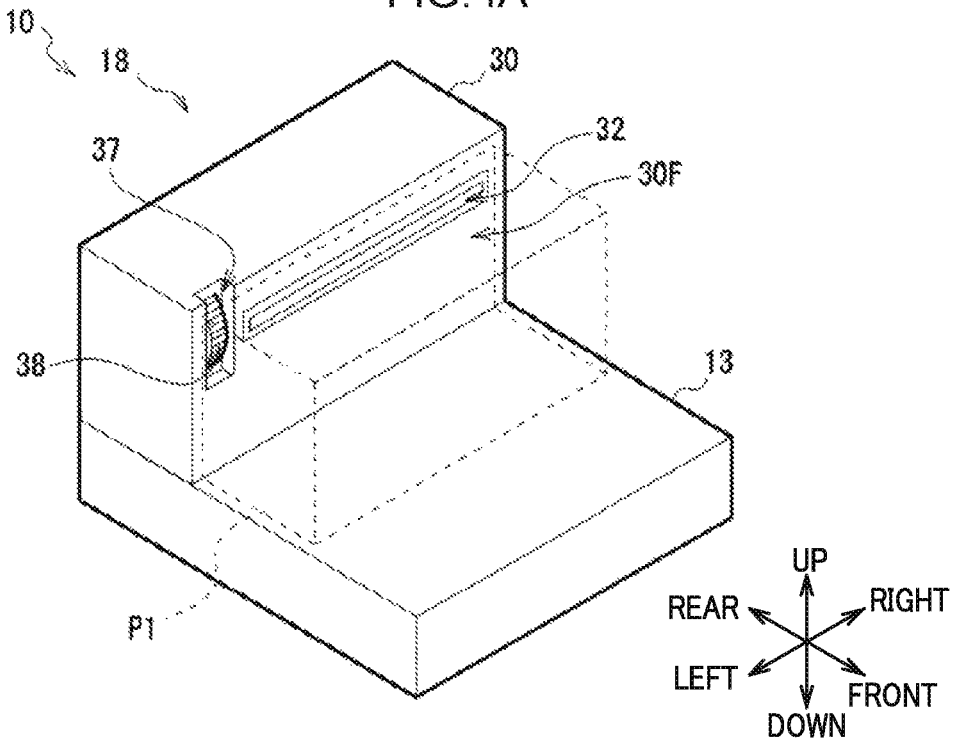
FIG. 4A is a schematic perspective view illustrating configuration of an upper conveyance section and an upper storage box according to a first exemplary embodiment.
Figure 4B:
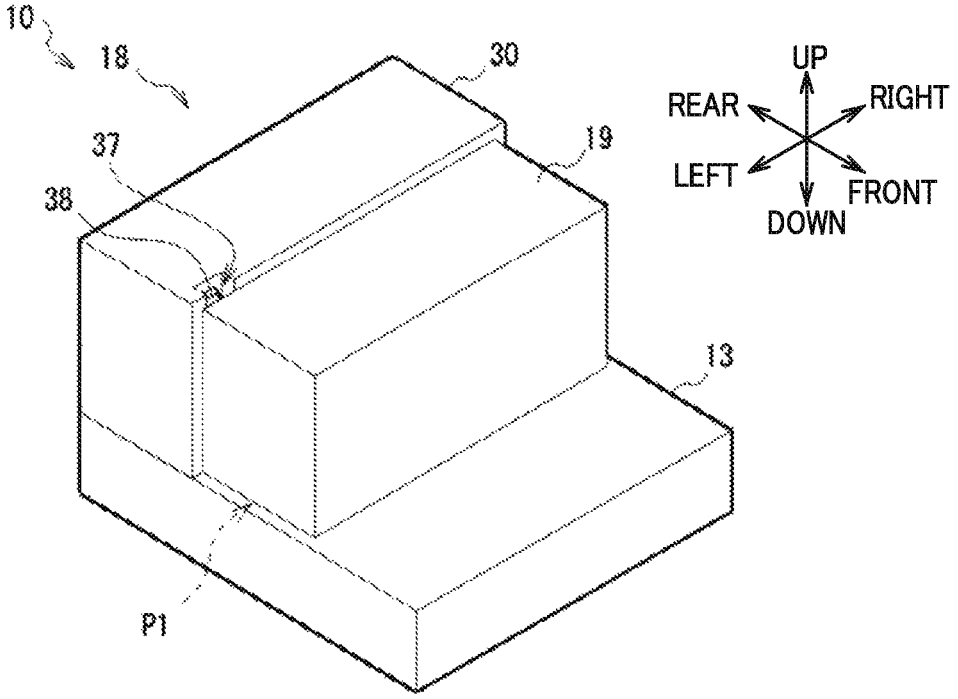
FIG. 4B is a schematic perspective view illustrating configuration of the upper conveyance section and the upper storage box according to the first exemplary embodiment.
Figure 5A:
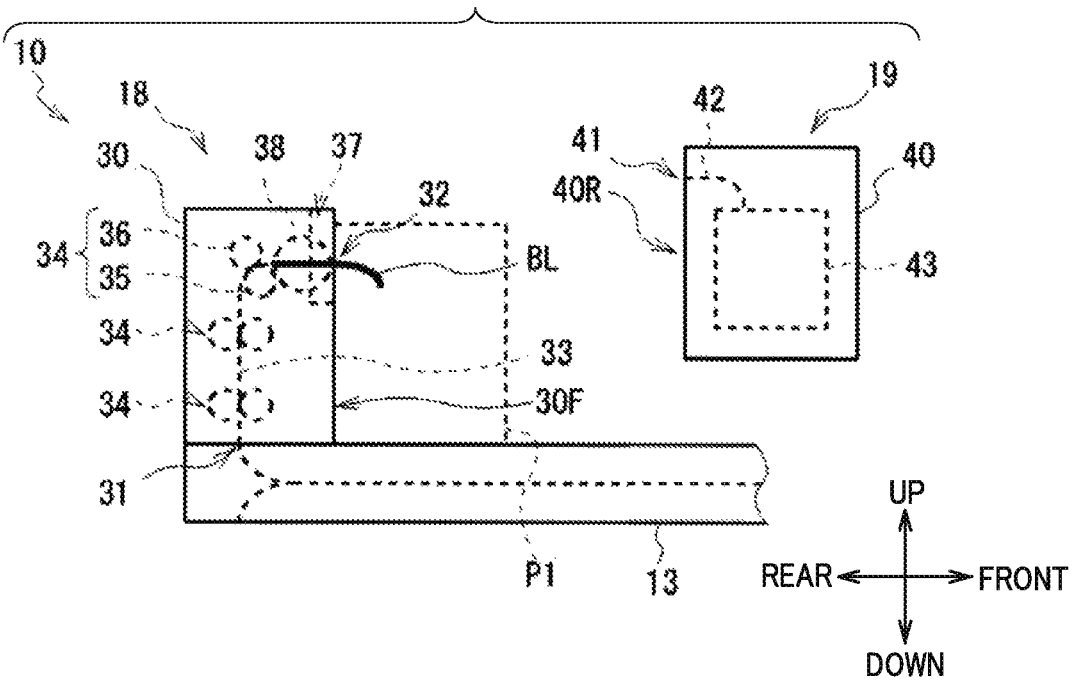
FIG. 5A is a schematic side view illustrating configuration of the upper conveyance section and the upper storage box according to the first exemplary embodiment.
Figure 5B:
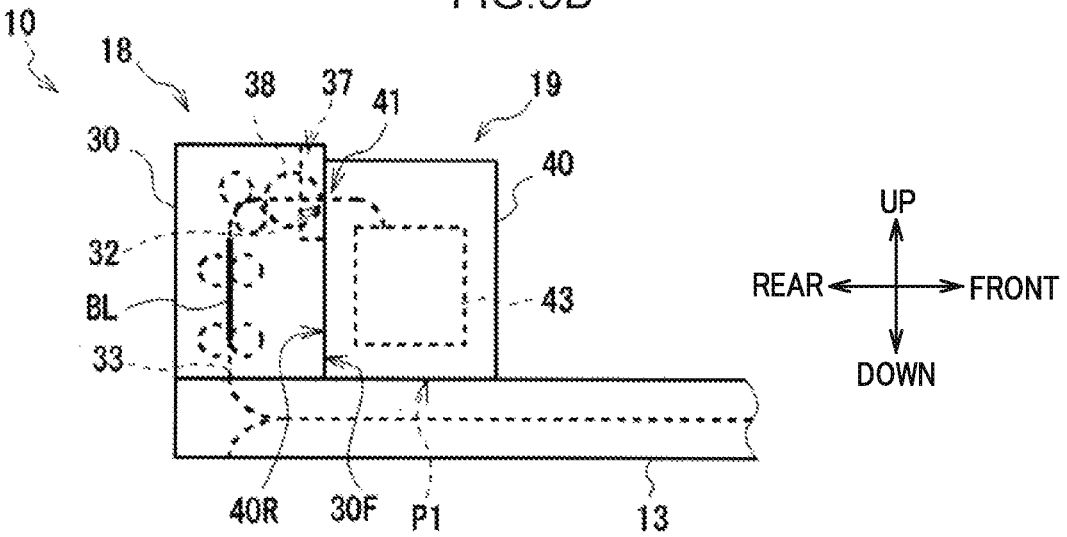
FIG. 5B is a schematic side view illustrating configuration of the upper conveyance section and the upper storage box according to the first exemplary embodiment.
Figure 6:
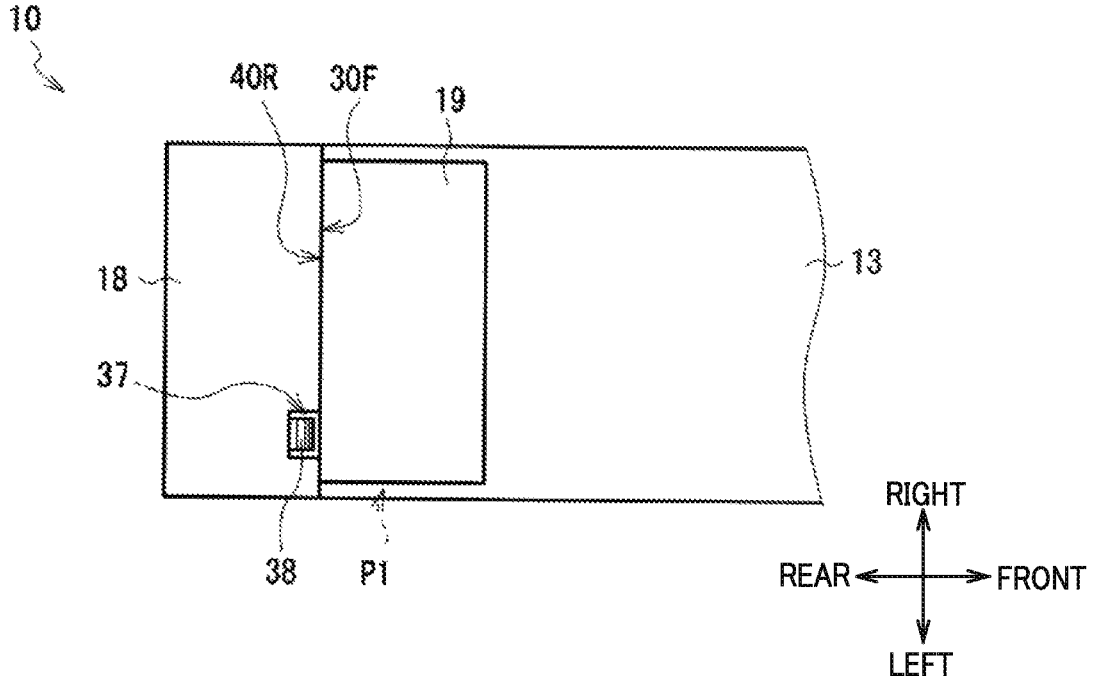
FIG. 6 is a schematic plan view illustrating configuration of the upper conveyance section and the upper storage box according to the first exemplary embodiment.

Next, explanation follows regarding configuration of the upper conveyance section 18 and the upper storage box 19, with reference to FIG. 4A and FIG. 4B, FIG. 5A and FIG. 5B, and FIG. 6. FIG. 4A and FIG. 4B are schematic perspective views, FIG. 5A and FIG. 5B are schematic side views from the left, and FIG. 6 is a schematic plan view.

The upper conveyance section 18 is generally configured in a rectangular block shape, and its periphery is covered by an upper conveyance section casing 30. A lower face of the upper conveyance section casing 30 is provided with a reception port 31 through which banknotes are received from the conveyance section 13. A passing port 32 through which banknotes are passed to the upper storage box 19 is provided in the vicinity of an upper end of an upper conveyance section front face 30F, this being a front face of the upper conveyance section casing 30.

As illustrated in FIG. 5A, a conveyance path 33 is formed inside the upper conveyance section 18 to convey banknotes from the reception port 31 toward the passing port 32. The conveyance path 33 guides banknotes upward from the reception port 31 using conveyance guides and the like, not illustrated in the drawings, and then redirects the banknotes toward the front so as to propel the banknotes toward the passing port 32.

Plural pairs of conveyance rollers 34 are disposed at predetermined intervals along the conveyance path 33 within the upper conveyance section 18. Each pair of conveyance rollers 34 is configured by a combination of a drive roller 35 disposed at the front side of the conveyance path 33 and a driven roller 36 disposed at the rear side of the conveyance path 33.

Each drive roller 35 is formed in a circular column shape with its axial center along the left-right direction, and is rotated by being supplied with drive force from a non-illustrated drive motor (also referred to as a drive source hereinafter) through gears, belts, or the like, not illustrated in the drawings. Each driven roller 36 is formed in a circular column shape with its axial center along the left-right direction similarly to the drive rollers 35, and is capable of freely rotating. Each driven roller 36 is pressed toward the front side, namely against the corresponding drive roller 35, by a spring, not illustrated in the drawings.

When a banknote is conveyed along the conveyance path 33 from below, the banknote is nipped between the drive roller 35 and the driven roller 36 of each pair of conveyance rollers 34. Drive force is transmitted from the rotating drive rollers 35, enabling the banknote to be conveyed further upward along the conveyance path 33.

The periphery of the conveyance path 33 in the upper conveyance section 18 is covered by a non-illustrated conveyance guide, the upper conveyance section casing 30, and the like. Accordingly, it is very difficult for a maintenance technician to see from the outside whether or not a banknote is present in the conveyance path 33 of the upper conveyance section 18.

As illustrated in FIG. 4A, a recess 37 that is set back further toward the rear than its surroundings is formed in a left side portion in the vicinity of the upper end of the upper conveyance section front face 30F of the upper conveyance section 18, namely at the left side of the passing port 32. The recess 37, serving as an operation knob-peripheral portion, is closed at the left side, right side, lower side, and rear side, and open at the front side and upper side, thereby forming a comparatively small cuboidal space that is long in the vertical direction. A rear side face of the recess 37 is formed with a hole that is long and narrow in the vertical direction and that penetrates the rear side face of the recess 37 in the front-rear direction.

An operation knob 38 is provided at the left side portion in the vicinity of the upper end of the upper conveyance section 18, namely at the left side of the passing port 32. The operation knob 38 is generally formed in a flattened circular disc shape with its axial center running in the left-right direction, and the vicinity of a front end of the operation knob 38 is exposed to the front of the recess 37, namely the interior of the recess 37, through the hole in the recess 37. The front end of the operation knob 38 is positioned so as to be aligned with or slightly to the rear side of the upper conveyance section front face 30F that serves as an operation side face.

The operation knob 38 is capable of rotating about a center of rotation positioned within the upper conveyance section casing 30, and is coordinated with the respective conveyance rollers 34 and drive rollers 35 through gears or the like, not illustrated in the drawings. Therefore, the respective conveyance rollers 34 and drive rollers 35 may be rotated by a maintenance technician rotating the operation knob 38 of the upper conveyance section 18. When this is performed, if a banknote BL remains in the conveyance path 33 of the upper conveyance section 18, the banknote BL may be propelled along the conveyance path 33. Namely, the banknote BL may be conveyed manually.

The upper storage box 19 is generally configured in a rectangular block shape, and the periphery of the upper storage box 19 is covered by an upper storage box casing 40. The vertical direction and left-right direction lengths of the upper storage box casing 40 are both slightly smaller (shorter) than those of the upper conveyance section casing 30 of the upper conveyance section 18.

The upper storage box 19 includes a reception port 41 that receives banknotes from the upper conveyance section 18 in the vicinity of an upper end of an upper storage box rear face 40R, this being a rear face of the upper storage box 19. The upper storage box 19 also includes an upper storage box internal conveyance path 42 that conveys banknotes within the upper storage box 19, and a storage space 43 that is a space for storing banknotes.

The upper storage box 19 is configured attachable to and detachable from a mounting location P1 at a front side of the upper conveyance section 18 at the upper side of the conveyance section 13. Namely, in a state in which the upper storage box 19 has been mounted to the mounting location P1 as illustrated in FIG. 4B and FIG. 5B, the upper storage box rear face 40R opposes the upper conveyance section front face 30F, and the reception port 41 and the passing port 32 are coupled together. The upper storage box 19 is thus capable of receiving banknotes from the upper conveyance section 18. This state is referred to as an "opposing state" or a "handover state" hereinafter. In the opposing state, the recess 37 of the upper conveyance section 18 may be understood as being indented in a direction away from the upper storage box 19.

From another perspective, in the opposing state in which the upper storage box 19 has been mounted to the mounting location P1, the passing port 32 of the upper conveyance section 18 that serves as an handover section is blocked off by the upper storage box 19. Accordingly, a maintenance technician performing a maintenance operation on the banknote pay-in/pay-out device 10 would have difficulty in visually checking whether or not a banknote is present in the passing port 32 or the state of a banknote being handed over.

In the opposing state, the upper storage box rear face 40R of the upper storage box 19 blocks off a large portion of the upper conveyance section 18, excluding the vicinity of the upper end on the front side of the recess 37. The upper storage box 19 therefore restricts the maintenance technician from operating the operation knob 38. In other words, when the upper storage box 19 is in the opposing state in the banknote pay-in/pay-out device 10, the passing port 32 of the upper conveyance section 18 is coupled to and blocked off by the reception port 41, and the majority of the operation knob 38 is also blocked off, thereby restricting operation by the maintenance technician.

As illustrated in FIG. 4A and FIG. 5A, when the maintenance technician lifts the upper storage box 19 from the mounting location P1 toward the upper front side, the upper storage box 19 is removed from the conveyance section 13 and the upper conveyance section 18, and the upper storage box rear face 40R is amply separated from the upper conveyance section front face 30F. This is referred to as a "non-opposing state" hereinafter. In this state, the entirety of the upper conveyance section front face 30F of the upper conveyance section 18, namely the passing port 32, the recess 37, and the operation knob 38, is exposed to the exterior, forming an ample space at the front side thereof (namely, at the mounting location P1).

In the non-opposing state of the upper conveyance section 18, the maintenance technician is therefore able to operate the operation knob 38 while looking at the operation knob 38 and the passing port 32, accompanying which the drive rollers 35 of the pairs of conveyance rollers 34 rotate. Therefore, in cases in which a banknote BL remains in the conveyance path 33 of the upper conveyance section 18, this banknote may be conveyed to the passing port 32 and discharged at the front of the upper conveyance section 18.

1-4. Effects

In the banknote pay-in/pay-out device 10 of the ATM 1 according to the first exemplary embodiment configured as described above, the upper conveyance section front face 30F of the upper conveyance section 18 is provided with the operation knob 38 and the passing port 32, and the upper storage box 19 is attachable to and detachable from the mounting location P1 that is adjacent to the front side of the upper conveyance section 18 (FIG. 4A to FIG. 6).

In the banknote pay-in/pay-out device 10, when the upper storage box 19 has been mounted at the mounting location P1 and the upper storage box rear face 40R is in the opposing state opposing the upper conveyance section front face 30F (FIG. 4B and FIG. 5B), the majority of the recess 37 and the front side of the operation knob 38 are blocked off by the upper storage box 19, enabling a maintenance technician to be restricted from operating the operation knob 38.

In other words, in the banknote pay-in/pay-out device 10, the maintenance technician is only able to operate the operation knob 38 in a state in which the upper storage box 19 has been removed from the mounting location P1 to achieve the non-opposing state in which the passing port 32 of the upper conveyance section 18 is exposed (FIG. 4A and FIG. 5A).

Accordingly, in the banknote pay-in/pay-out device 10, although it is very difficult to see whether or not a banknote is present or confirm its position inside the upper conveyance section 18 from the exterior, the issue that a maintenance technician may unintentionally cause a banknote that has been conveyed to the passing port 32 of the upper conveyance section 18 to be stored in the upper storage box 19, and the issue that the maintenance technician may not be aware of this, are forestalled. This enables a resulting difference between the number of banknotes in each section as recorded by the banknote controller 11 and the actual number of banknotes stored in each section to be avoided in the banknote pay-in/pay-out device 10.

From another perspective, when the upper storage box 19 is in the opposing state in the banknote pay-in/pay-out device 10, the reception port 41 is coupled to the passing port 32 of the upper conveyance section 18. Accordingly, it is necessary to place the upper storage box 19 in the non-opposing state in order to expose the passing port 32. In consideration of this, the operation knob 38 is covered in addition to the passing port 32 when the upper storage box 19 is in the opposing state in the banknote pay-in/pay-out device 10, such that when the maintenance technician places the upper storage box 19 in the non-opposing state in order to expose the passing port 32, the operation knob 38 may be exposed at the same time without requiring any other operations.

In the opposing state (FIG. 4B and FIG. 5B) in the banknote pay-in/pay-out device 10, the upper storage box casing 40 of the upper storage box 19 is used to block off the front side of the operation knob 38. Accordingly, there is no need to provide a separate component to block off the operation knob 38 in the banknote pay-in/pay-out device 10, and there is also no need to provide a mechanism or the like to displace such a component accompanying attachment or detachment of the upper storage box 19.

The upper side of the recess 37 in the upper conveyance section 18 is open in the banknote pay-in/pay-out device 10, such that when the upper storage box 19 is in the opposing state mounted to the mounting location P1, part of the operation knob 38 is exposed to the exterior, and the maintenance technician is able to see this part of the operation knob 38 from the upper side. Accordingly, in the banknote pay-in/pay-out device 10, the position of the operation knob 38 may be seen even by a maintenance technician who is not entirely familiar with the structure of the banknote pay-in/pay-out device 10, who is then able to understand intuitively that removal of the upper storage box 19 will enable operation of the operation knob 38.

Moreover, the recess 37 and the operation knob 38 are provided in the vicinity of the passing port 32 in the banknote pay-in/pay-out device 10, namely at locations at the same height and close to the left side of the passing port 32 (FIG. 4A and FIG. 4B, FIG. 5A and FIG. 5B). Accordingly, when a maintenance technician looks at the operation knob 38 in order to operate the operation knob 38 in the banknote pay-in/pay-out device 10, the passing port 32 may also be included within the field of view, enabling the presence of any banknote discharged from the passing port 32 to be reliably noticed.

According to the configuration described above, the banknote pay-in/pay-out device 10 of the ATM 1 according to the first exemplary embodiment is capable of restricting operation of the operation knob 38 by a maintenance technician when the upper storage box 19 is in the opposing state and the passing port 32 is coupled to the reception port 41, enabling banknotes to be prevented from being conveyed into the upper storage box 19. Further, when the upper storage box 19 of the banknote pay-in/pay-out device 10 is in the non-opposing state and the passing port 32 of the upper conveyance section 18 has been exposed, operation of the operation knob 38 by the maintenance technician is permitted, and a banknote inside the upper conveyance section 18 may be conveyed manually and discharged through the passing port 32. As a result, the banknote pay-in/pay-out device 10 is capable of forestalling a mismatch between the number of banknotes in each section as recorded by the banknote controller 11, and the actual number of banknotes stored in each section.

2. Second Exemplary Embodiment

An ATM 101 (FIG. 1) according to a second exemplary embodiment differs from the ATM 1 according to the first exemplary embodiment in that a banknote pay-in/pay-out device 110 is provided in place of the banknote pay-in/pay-out device 10, but is otherwise configured similarly thereto.

The banknote pay-in/pay-out device 110 (FIG. 2) differs from the banknote pay-in/pay-out device 10 according to the first exemplary embodiment in that an upper conveyance section 118 and an upper storage box 119 are provided in place of the upper conveyance section 18 and the upper storage box 19, but is otherwise configured similarly thereto.

As illustrated in FIG. 7A and FIG. 7B, FIG. 8A and FIG. 8B, and FIG. 9, which respectively correspond to FIG. 4A and FIG. 4B, FIG. 5A and FIG. 5B, and FIG. 6, the upper conveyance section 118 has substantially the same configuration as the upper conveyance section 18 according to the first exemplary embodiment. However, the upper conveyance section 118 differs from the first exemplary embodiment in that an upper conveyance section casing 130 and an operation knob 138 are provided corresponding to the upper conveyance section casing 30 and the operation knob 38.

The upper conveyance section casing 130 is generally configured in a rectangular block shape, similarly to the upper conveyance section casing 30 according to the first exemplary embodiment. However, an upper conveyance section front face 130F configuring a front face of the upper conveyance section casing 130 is flat at a location on the left side in the vicinity of an upper end of the upper conveyance section casing 130, namely at a location corresponding to the recess 37, and is penetrated by a hole formed in the front-rear direction.

The operation knob 138 is configured as a circular disc with its axial center running in the left-right direction similarly to the operation knob 38 according to the first exemplary embodiment, but the attachment position of the operation knob 138 to the upper conveyance section casing 130 is slightly further toward the front than in the first exemplary embodiment. Namely, the vicinity of a front end of the operation knob 138 projects to the front through the hole in the upper conveyance section front face 130F.

The upper storage box 119 has substantially the same configuration as the upper storage box 19 according to the first exemplary embodiment, but is not detachable from the upper face of the conveyance section 13. Instead, the upper storage box 119 is capable of swinging.

Specifically, an upper storage box casing 140 of the upper storage box 119 is configured in a substantially rectangular block shape similarly to the upper storage box casing 40 according to the first exemplary embodiment, but has a shape in which a front lower portion is cut away obliquely as viewed along the left-right direction. The upper storage box casing 140 is capable of swinging with respect to the conveyance section 13 about a swing shaft 144 provided at a front lower side of the upper storage box casing 140.

Figure 7A:
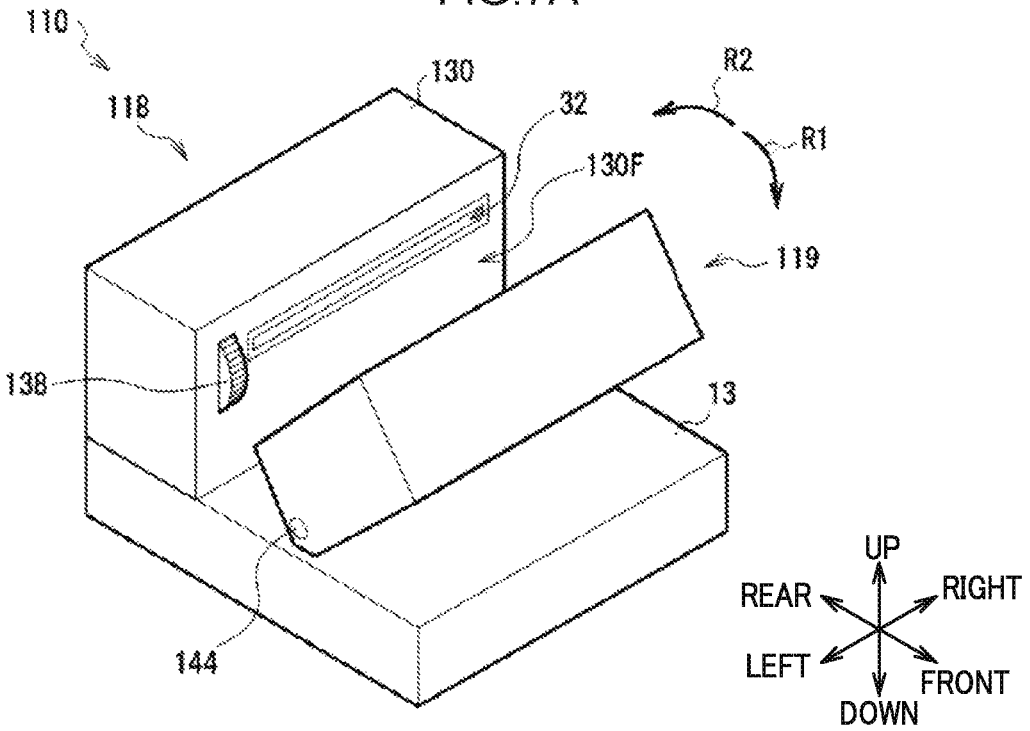
FIG. 7A is a schematic perspective view illustrating configuration of an upper conveyance section and an upper storage box according to a second exemplary embodiment.
Figure 7B:
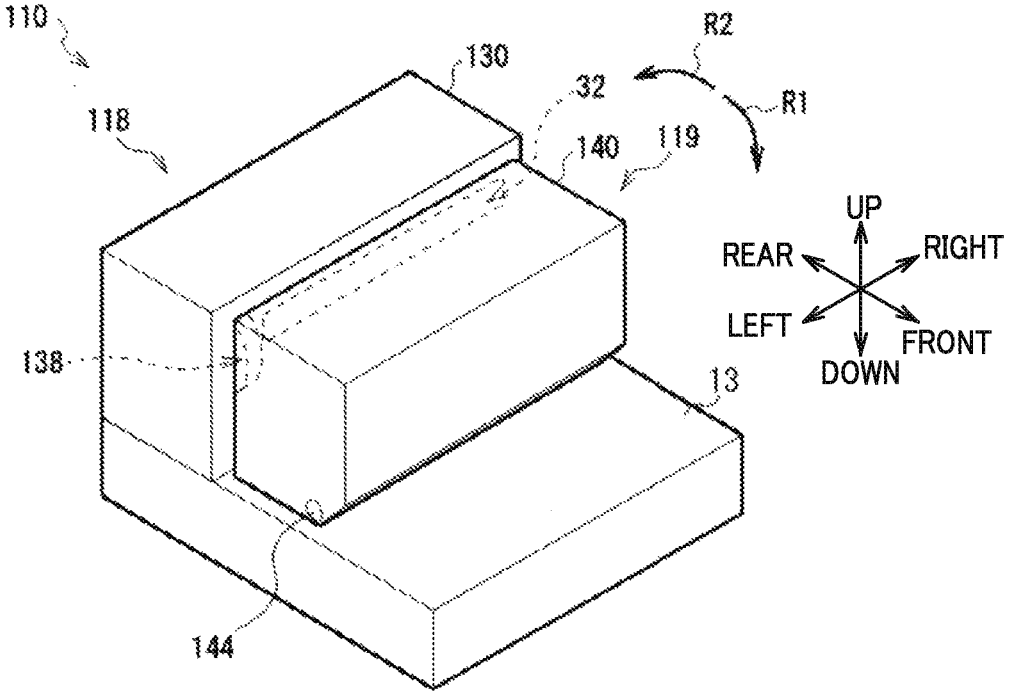
FIG. 7B is a schematic perspective view illustrating configuration of the upper conveyance section and the upper storage box according to the second exemplary embodiment.
Figure 8A:
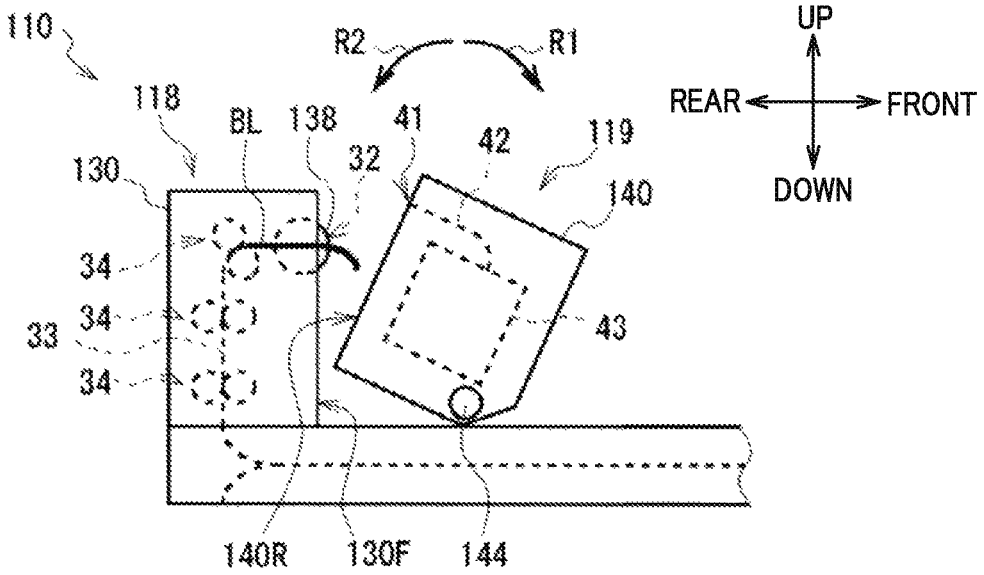
FIG. 8A is a schematic side view illustrating configuration of the upper conveyance section and the upper storage box according to the second exemplary embodiment.
Figure 8B:
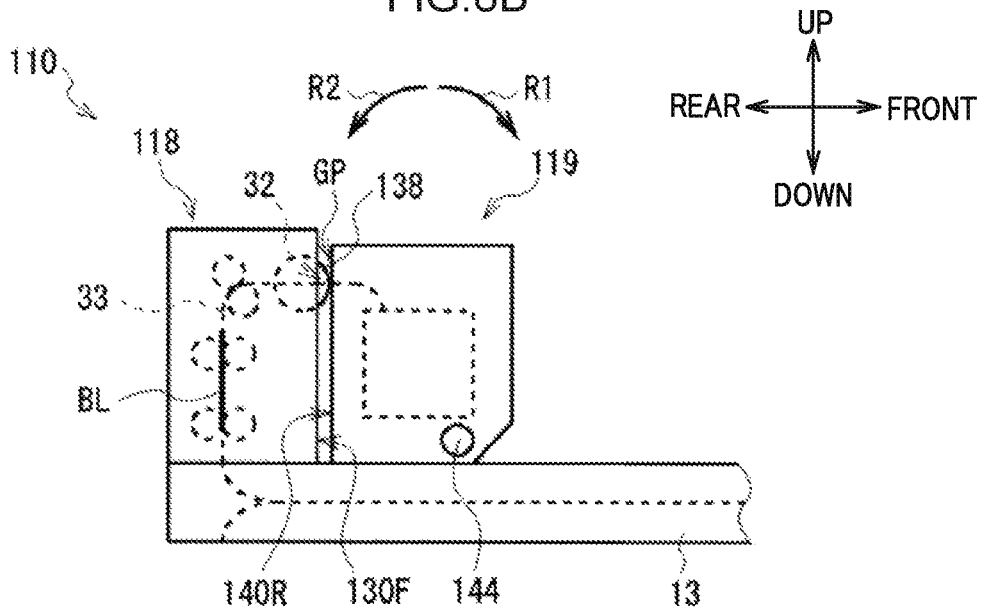
FIG. 8B is a schematic side view illustrating configuration of the upper conveyance section and the upper storage box according to the second exemplary embodiment.
Figure 9:
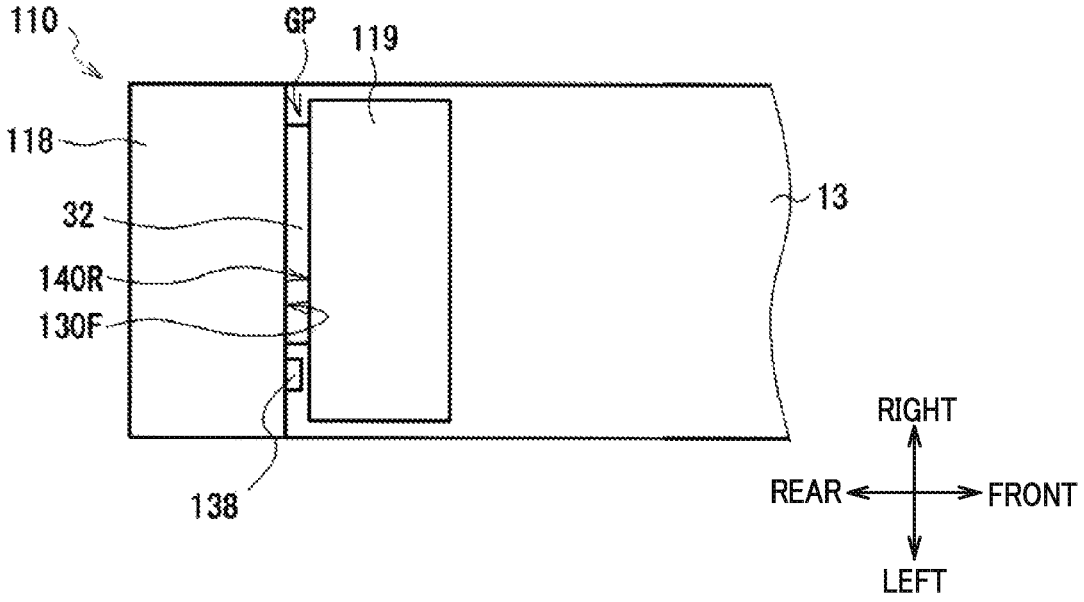
FIG. 9 is a schematic plan view illustrating configuration of the upper conveyance section and the upper storage box according to the second exemplary embodiment.

Namely, as illustrated in FIG. 7B and FIG. 8B, when the upper storage box casing 140 has swung about the swing shaft 144 in the arrow R2 direction, an upper storage box rear face 140R adopts a state facing substantially straight toward the rear so as to oppose the upper conveyance section front face 130F, and the reception port 41 is coupled to the passing port 32 of the upper conveyance section 118. This is referred to as the opposing state in the present exemplary embodiment. The upper storage box 119 is thus capable of receiving banknotes from the upper conveyance section 118.

In this state, the upper storage box rear face 140R of the upper storage box casing 140 of the upper storage box 119 covers the operation knob 138 from the front, thus restricting operation of the operation knob 138 by a maintenance technician. In the opposing state, the upper storage box rear face 140R of the upper storage box 119 is positioned slightly further toward the front than the front end of the operation knob 138, such that a slight gap GP is formed between the upper storage box rear face 140R and the upper conveyance section front face 130F of the upper conveyance section 118. Accordingly, although a maintenance technician is unable to operate the operation knob 138, the maintenance technician is able to visually confirm the presence and position of the operation knob 138.

As illustrated in FIG. 7A and FIG. 8A, when the upper storage box casing 140 has been swung about the swing shaft 144 in the arrow R1 direction, the upper storage box rear face 140R adopts an orientation facing obliquely upward toward the rear, and the reception port 41 is separated from the upper conveyance section front face 130F and the passing port 32 of the upper conveyance section 118. This is referred to as the non-opposing state in the present exemplary embodiment. In this state, the upper storage box rear face 140R of the upper storage box 119 is amply separated from the operation knob 138, thereby permitting the maintenance technician to operate the operation knob 138.

In the above configuration, the banknote pay-in/pay-out device 110 of the ATM 101 according to the second exemplary embodiment is provided with the operation knob 138 and the passing port 32 on the upper conveyance section front face 130F of the upper conveyance section 118, and the upper storage box 119 disposed at the front side of the upper conveyance section 118 is swung so as to transition between the opposing state and the non-opposing state (FIG. 7A to FIG. 9).

Accordingly, when the upper storage box 119 is in the opposing state (FIG. 7B and FIG. 8B) in the banknote pay-in/pay-out device 110, the front side of the operation knob 138 is blocked off by the upper storage box 119, enabling a maintenance technician to be restricted from operating the operation knob 138. In other words, in the banknote pay-in/pay-out device 110, the maintenance technician is only able to operate the operation knob 138 when the upper storage box 119 is in the non-opposing state and the passing port 32 of the upper conveyance section 118 has been exposed (FIG. 7A and FIG. 8A).

Accordingly, similarly to the first exemplary embodiment, the issue of a banknote that has been conveyed to the passing port 32 of the upper conveyance section 118 being stored in the upper storage box 119 without this being the intention of a maintenance technician, and the issue of this going unnoticed by the maintenance technician, are forestalled in the banknote pay-in/pay-out device 110.

Moreover, swinging the upper storage box 119 enables the banknote pay-in/pay-out device 110 to transition between the opposing state and the non-opposing state (FIG. 7A and FIG. 7B, FIG. 8A and FIG. 8B). Accordingly, unlike in the case of the first exemplary embodiment in which the upper storage box 19 is detached and reattached, there is no need to lift up the upper storage box 19, nor to lower the upper storage box 19 into position in the banknote pay-in/pay-out device 110, thereby relieving the operational burden on the maintenance technician.

In other respects, the banknote pay-in/pay-out device 110 according to the second exemplary embodiment is capable of exhibiting similar operation and effects to the banknote pay-in/pay-out device 10 according to the first exemplary embodiment.

In the banknote pay-in/pay-out device 110 of the ATM 101 according to the second exemplary embodiment with the above configuration, when the upper storage box 119 is in the opposing state and the passing port 32 is coupled to the reception port 41, a maintenance technician is restricted from operating the operation knob 138, thereby enabling banknotes to be prevented from being conveyed into the upper storage box 119. However, when the upper storage box 119 of the banknote pay-in/pay-out device 110 is in the non-opposing state and the passing port 32 of the upper conveyance section 118 has been exposed, the maintenance technician is allowed to operate the operation knob 138, and a banknote inside the upper conveyance section 118 may be conveyed manually and discharged through the passing port 32. As a result, similarly to the first exemplary embodiment, the banknote pay-in/pay-out device 110 is capable of forestalling a mismatch between the number of banknotes in each section as recorded by the banknote controller 11, and the actual number of banknotes stored in each section.

3. Other Exemplary Embodiments

In the first exemplary embodiment described above, explanation has been given regarding a case in which the upper storage box 19 is attached to and detached from the mounting location P1 at the front side portion of the upper conveyance section 18. In the second exemplary embodiment, explanation has been given regarding a case in which the upper storage box 119 is swung at the front side of the upper conveyance section 118. However, the present disclosure is not limited thereto, and the upper storage box 19 may be configured to transition between an opposing state and a non-opposing state by various means such as sliding the upper storage box 19 along the vertical direction or the front-rear direction.

Figure 10:
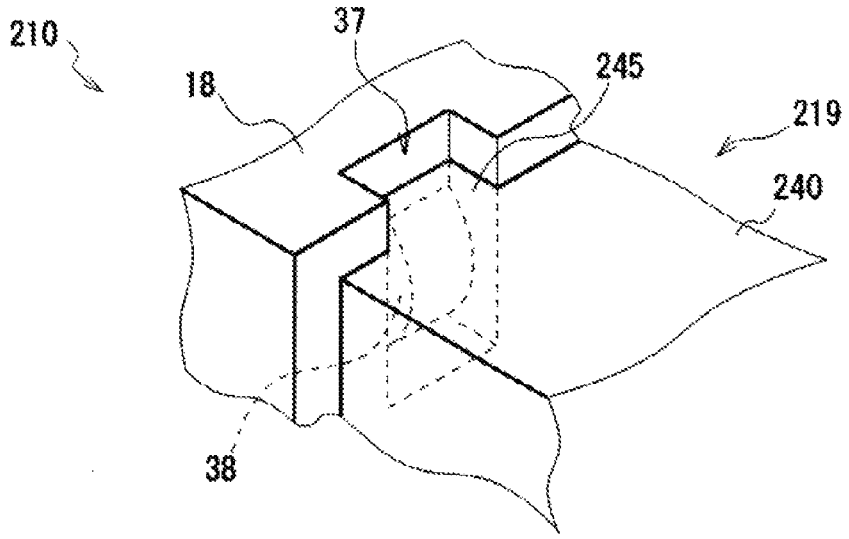
FIG. 10 is a schematic perspective view illustrating configuration of an upper conveyance section and an upper storage box according to another exemplary embodiment.

In the first exemplary embodiment described above, explanation has been given regarding a case in which the upper side of the recess 37 in the upper conveyance section 18 is open, enabling a maintenance technician to see the operation knob 38 when the upper storage box 19 is in the opposing state. However, the present disclosure is not limited thereto, and as illustrated in FIG. 10, for example, a projection 245 projecting toward the rear may be provided in an upper storage box casing 240 of an upper storage box 219 at a location corresponding to the recess 37, such that a maintenance technician is not able to see the operation knob 38 when the upper storage box 219 is in the opposing state.

Figure 11:
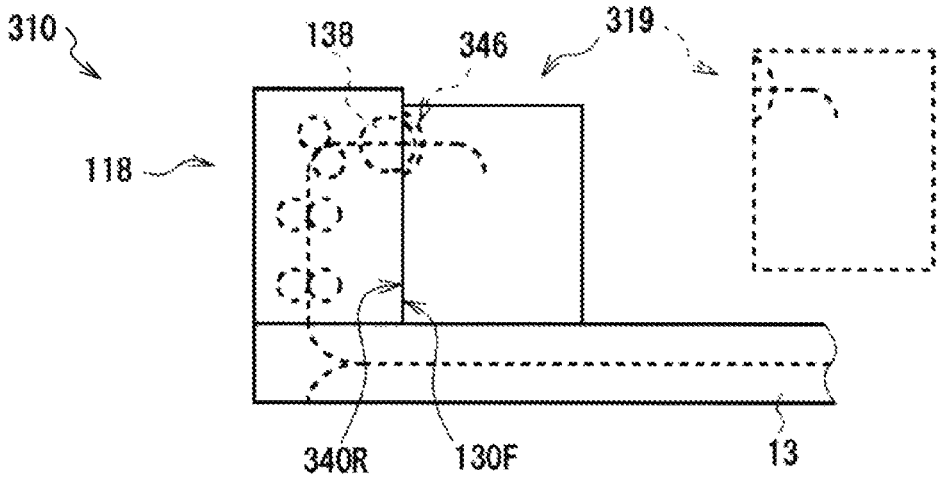
FIG. 11 is a schematic view illustrating configuration of an upper conveyance section and an upper storage box according to another exemplary embodiment.

In the first exemplary embodiment described above, explanation has been given regarding a case in which the recess 37 that is indented further toward the rear than the upper conveyance section front face 30F is provided to the upper conveyance section 18, and the vicinity of the front end of the operation knob 38 is positioned in the recess 37 such that the upper storage box rear face 40R of the upper storage box 19 is formed with a flat profile (FIG. 4A to FIG. 6). However, the present disclosure is not limited thereto, and as in a banknote pay-in/pay-out device 310 illustrated FIG. 11, for example, the vicinity of a front end of the operation knob 138 may project out further toward the front than the upper conveyance section front face 130F of the upper conveyance section 118 that is similar to the second exemplary embodiment, and an upper storage box rear face 340R of an upper storage box 319 provided in place of the upper storage box 19 may be formed with a recess 346 at a location opposing the operation knob 138. In the banknote pay-in/pay-out device 310, the vicinity of the front end of the operation knob 138 enters the recess 346 when the upper storage box 319 is in the opposing state, such that a maintenance technician is not able to see the operation knob 138.

Figure 12:
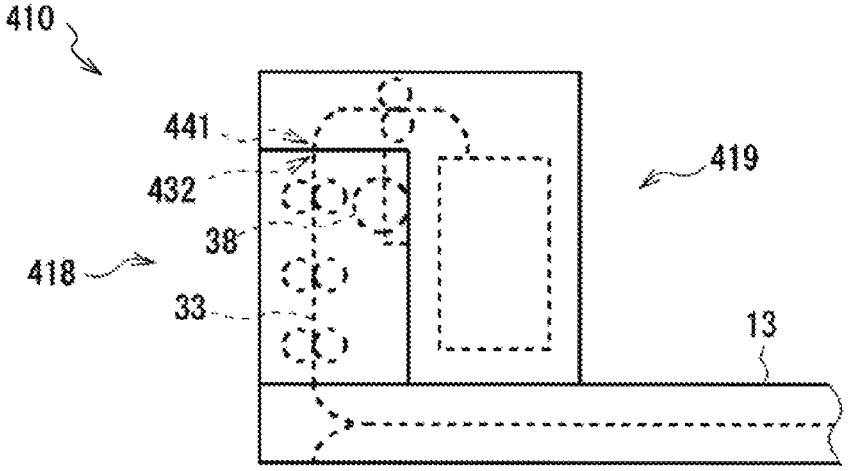
FIG. 12 is a schematic view illustrating configuration of an upper conveyance section and an upper storage box according to another exemplary embodiment.

In the first exemplary embodiment described above, explanation has been given regarding a case in which both the operation knob 38 and the passing port 32 are provided to the upper conveyance section front face 30E However, the present disclosure is not limited thereto, and as in a banknote pay-in/pay-out device 410 illustrated in FIG. 12, for example, a passing port 432 may be disposed in an upper face of an upper conveyance section 418, and in the opposing state, an upper storage box 419 may face both the front side and upper side of the upper conveyance section 418 to couple a reception port 441 to the passing port 432. Namely, the operation knob 38 and the passing port 432 may be provided on different side faces of the upper conveyance section 418. The same also applies to the second exemplary embodiment.

In the first exemplary embodiment described above, explanation has been given regarding a case in which the passing port 32 and the operation knob 38 are provided to the upper conveyance section front face 30F, this being the front face of the upper conveyance section 18, and the upper storage box rear face 40R of the upper storage box 19 opposes the passing port 32 and the operation knob 38 in the opposing state. However, the present disclosure is not limited thereto, and the passing port 32 and the operation knob 38 may be provided to various side faces of the upper conveyance section 18. For example, the passing port 32 and the operation knob 38 may be provided to an upper side face of the upper conveyance section 18 such that the upper storage box 19 is attached to and detached from the upper side of the upper conveyance section 18. In essence, it is sufficient that the maintenance technician be restricted from operating the operation knob 38 when in the opposing state, and be permitted to operate the operation knob 38 when in the non-opposing state. The same also applies to the second exemplary embodiment.

In the first exemplary embodiment described above, explanation has been given regarding a case in which the operation knob 38 is coordinated with the drive rollers 35 such that when the drive rollers 35 are rotated by the drive motor (not illustrated in the drawings), the operation knob 38 also rotates. However, the present disclosure is not limited thereto, and, for example, configuration may be made in which the operation knob 38 is capable of moving in the front-rear direction and is urged toward the front by a spring or the like to release meshing of an internal gear, with the internal gear only meshing when the operation knob 38 has been pushed toward the rear by a maintenance technician so as to be coordinated with the drive rollers 35. This thereby enables the operation knob 38 to be kept stationary when the drive rollers 35 are being rotated by the drive motor. The same also applies to the second exemplary embodiment.

In the first exemplary embodiment described above, explanation has been given regarding a case in which the operation knob 38 is configured in a circular disc shape, and the operation knob 38 is rotated by a maintenance technician in order to rotate the drive rollers 35 and convey a banknote manually. However, the present disclosure is not limited thereto, and, for example, the operation knob 38 may be configured by an operation element (i.e., a grip) of a lever that slides in the vertical direction, such that moving this lever in the vertical direction conveys a banknote manually. The same also applies to the second exemplary embodiment.

In the first exemplary embodiment described above, explanation has been given regarding a case in which the upper storage box 19 is employed as a counterfeit note storage box, namely a case in which banknotes (counterfeit notes) conveyed by the upper conveyance section 18 are stored, and the banknotes are not fed out from the upper storage box 19 during pay-out processing and the like. However, the present disclosure is not limited thereto, and, for example, re-usable banknotes may be stored in the upper storage box 19 similarly to the banknote storage boxes 16 (FIG. 2), and banknotes fed out from the upper storage box 19 in pay-out processing and the like may be handed over from the reception port 41 to the passing port 32, and may be conveyed downward along the upper conveyance section 18. The same also applies to the second exemplary embodiment.

In the first exemplary embodiment described above, explanation has been given regarding a case in which the present disclosure is applied to the banknote pay-in/pay-out device 10 of the ATM 1 that conducts transactions with a customer using banknotes as a medium. However, the present disclosure is not limited thereto, and may, for example, be applied to various devices that handlesheet-shaped media such as various securities, coupons, shopping vouchers, entry tickets, or the like. The same also applies to the second exemplary embodiment.

The present disclosure is not limited to the respective exemplary embodiments or the other exemplary embodiments described above. Namely, application of the present disclosure encompasses embodiments in which the respective exemplary embodiments and the other exemplary embodiments described above are appropriately combined in whole or in part, and exemplary embodiments extrapolated in part therefrom.

In the first exemplary embodiment described above, explanation has been given regarding a case in which in the banknote pay-in/pay-out device 10 serving as a medium processing device is configured by the upper conveyance section 18 serving as a conveyance section, the drive roller 35 serving as a drive transmission section, the operation knob 38 serving as an operation knob, and the upper storage box 19 serving as a storage box. However, the present disclosure is not limited thereto, and a medium processing device may be configured by a conveyance section, a drive transmission section, an operation knob, and a storage box of various other configurations.

INDUSTRIAL APPLICABILITY

The present disclosure may, for example, be employed in an ATM that performs banknote transactions with a customer.

The invention claimed is:

1. A medium processing device comprising:

a conveyance section that conveys a sheet-shaped medium along a conveyance path;

a drive transmission section that transmits drive force to the medium so as to cause the medium to travel along the conveyance path;

an operation knob that is provided on an operation side face of the conveyance section, and that is used for operating the drive transmission section; and a storage box that stores the medium therein, and that is capable of transitioning between an opposing state in which the storage box opposes the operation side face of the conveyance section over a range including at least the operation knob, and a non-opposing state in which the storage box does not oppose the operation side face.

2. The medium processing device of claim 1, further comprising a handover section that is provided to the operation side face of the conveyance section, and that hands over the medium to the storage box when the storage box is in the opposing state.

3. The medium processing device of claim 1, wherein part of the operation knob is exposed to the exterior when the storage box is in the opposing state.

4. The medium processing device of claim 3, wherein an operation knob-peripheral portion formed on the operation side face of the conveyance section at a periphery of the operation knob is indented in a direction away from the storage box when the storage box is in the opposing state.

5. The medium processing device of claim 1, wherein the storage box blocks off the operation knob from the exterior when in the opposing state.

6. The medium processing device of claim 1, wherein the storage box is detachable with respect to a mounting location adjacent to the conveyance section, and the storage box adopts the opposing state when mounted to the mounting location, and adopts the non-opposing state when removed from the mounting location.

7. The medium processing device of claim 1, wherein the storage box swings about a predetermined swing axis to transition between the opposing state and the non-opposing state.

8. A medium transaction device comprising:

an operation display section that displays operation screens during a transaction with a user;

a pay-in/pay-out port into which banknotes are inserted by the user, and that dispenses banknotes to be paid out to the user;

a conveyance section that conveys a sheet-shaped medium for transaction with the user along a conveyance path;

a drive transmission section that transmits drive force to the medium so as to cause the medium to travel along the conveyance path;

an operation knob that is provided on an operation side face of the conveyance section, and that is used for operating the drive transmission section; and a storage box that stores the medium therein, and that is capable of transitioning between an opposing state in which the storage box opposes the operation side face of the conveyance section over a range including at least the operation knob, and a non-opposing state in which the storage box does not oppose the operation side face.

* * * * *